US005760689A

United States Patent [19]

Holmgren

[11] Patent Number: 5,760,689

[45] Date of Patent: Jun. 2, 1998

[54] ANTI-THEFT BOX

[75] Inventor: Bertil Holmgren, Vellinge, Sweden

[73] Assignee: MW Trading APS, Glyngore, Denmark

[21] Appl. No.: 635,922

[22] PCT Filed: Nov. 29, 1994

[86] PCT No.: PCT/SE94/01141

§ 371 Date: May 28, 1996

§ 102(e) Date: May 28, 1996

[87] PCT Pub. No.: WO95/14841

PCT Pub. Date: Jun. 1, 1995

[30] Foreign Application Priority Data

Nov. 29, 1993 [SE] Sweden ..... 9303945

[51] Int. Cl.[6] ..... G08B 13/14

[52] U.S. Cl. ..... 340/568; 340/572; 340/693; 70/168; 70/276; 70/57.1; 70/63; 292/201; 292/251.5

[58] Field of Search ..... 340/572, 551, 340/568, 693; 70/168, 276, 57.1, 63; 292/37, 140, 201, 159, 251.5

[56] References Cited

U.S. PATENT DOCUMENTS

| | | | |
|---|---|---|---|
| 806,768 | 12/1905 | Bauer | 70/168 |
| 2,729,088 | 1/1956 | Huot et al. | 70/63 |
| 3,744,833 | 7/1973 | Berducone | 292/251.5 |
| 4,466,540 | 8/1984 | Lotrous et al. | 206/387 |
| 4,782,675 | 11/1988 | Thorburn | 70/129 |
| 4,966,020 | 10/1990 | Fotheringham et al. | 70/276 |
| 5,129,330 | 7/1992 | McKay et al. | 109/59 R |
| 5,209,086 | 5/1993 | Bruhwiler | 70/57.1 |
| 5,289,914 | 3/1994 | Holmgren | 206/1.5 |
| 5,468,031 | 11/1995 | Holmgren | 292/81 |
| 5,481,889 | 1/1996 | Richard et al. | 70/118 |

FOREIGN PATENT DOCUMENTS

| | | |
|---|---|---|
| 0522679 | 1/1993 | European Pat. Off. . |
| 2025451 | 4/1976 | Germany . |

*Primary Examiner*—Jeffery Hofsass
*Assistant Examiner*—Benjamin C. Lee
*Attorney, Agent, or Firm*—Merchant Gould Smith Edell Welter & Schmidt

[57] ABSTRACT

An anti-theft box displays goods that are attractive by theft in shops and department stores. The anti-theft box includes a cassette (10) having a lid (11). An element is provided on or in the anti-theft box for wireless activation of an alarm device if the anti-theft box is carried through an exit of a shop or a department store. A lock mechanism is provided on the inside of the lid, which includes a lock slide (15) provided with lock bolts (16), which can be displaced in plane parallel fashion in order to bring the lock bolts into and out of locking engagement with the cassette (10). A latch mechanism (36) is provided to latch, in an engaged position thereof, the lock side with the lock bolts in the engaged position and can be actuated to a disengaged position by means of a special tool to allow displacement of the lock bolts from the engaged position.

8 Claims, 9 Drawing Sheets

ANTI-THEFT BOX

The invention relates to an anti-theft box for displaying goods that are attractive by theft in shops and department stores, comprising a cassette having a lid which can be locked in closed position and can be unlocked only by means of a special tool, and an element on or in the anti-theft box for wireless activation of an alarm device if the anti-theft box is carried through the exit of the shop or the department store. The term "exit" then includes also the exit from a defined sales region in a department store or shop center.

Anti-theft boxes of this kind are used for displaying i.a. jewellery, watches and other small and expensive products and for displaying video-cassettes and video-games.

Specific demands are placed on an anti-theft box of the kind referred to above in order that such anti-theft boxes shall be used by the retail trade:

- the anti-theft box should not require too much space by having projecting portions because the display of the goods as a consequence thereof can be considerably more difficult since the anti-theft boxes in that case cannot be displayed in the shop on existing shelves or in existing racks without considerably enlarged space being required;
- it must be possible to produce the anti-theft box at reasonable costs so that the owner of the shop has not to bear too large costs in order to prevent theft of the displayed goods;
- the anti-theft box should not restrict the sale but should allow the customer to see unimpededly the goods enclosed in the box;
- the anti-theft box should not be cumbersome to handle by the shop attendants but should be easy to open at sale of the goods, preferably by using one hand only.

The purpose of the invention is to satisfy all these demands, and for this purpose the anti-theft box according to the invention has obtained the characterising features of claim 1.

Figure 1:
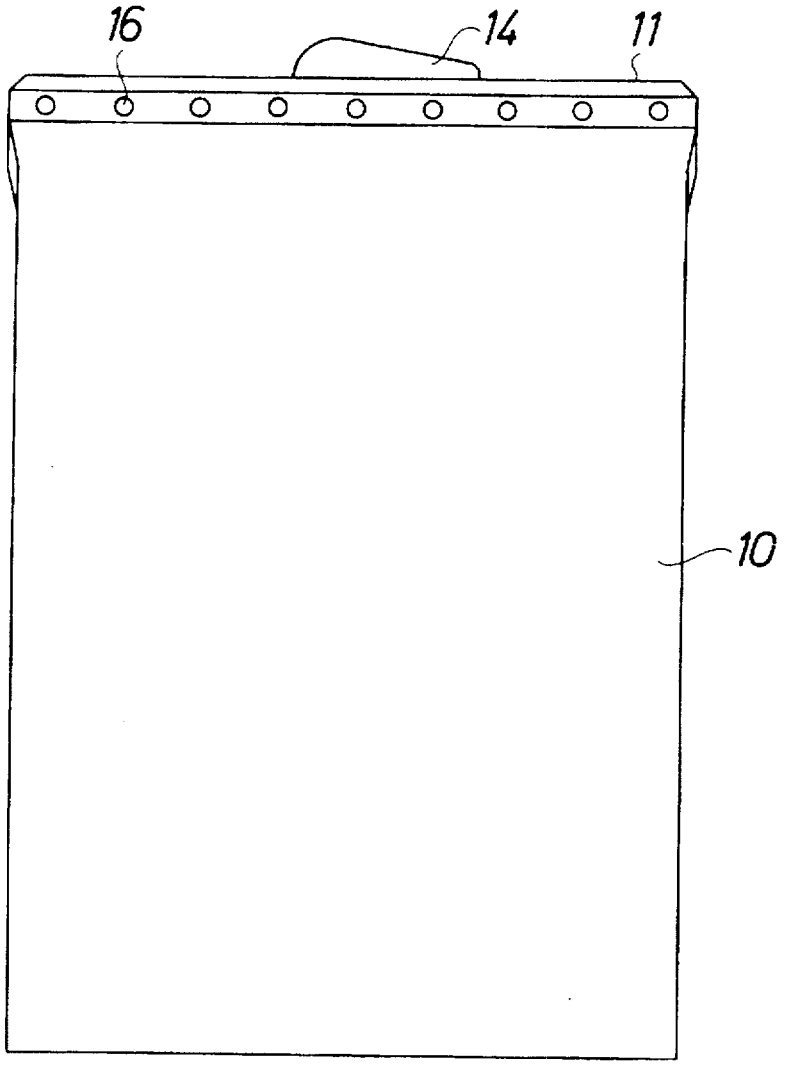
Figure 3:
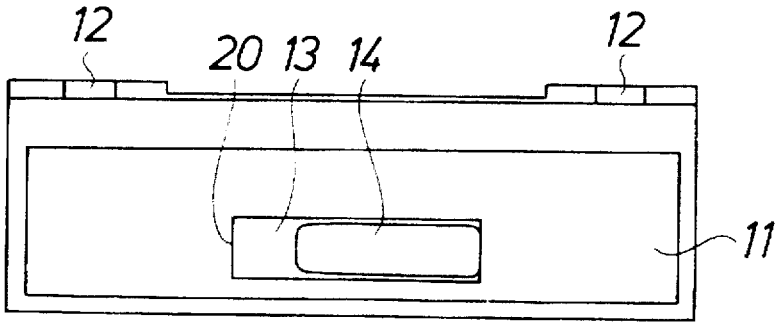
Figure 7:
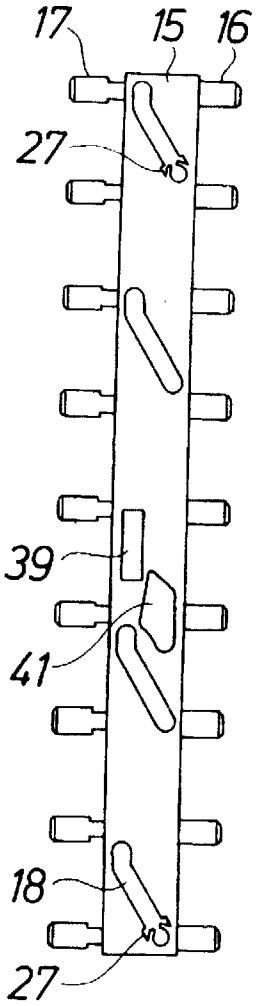
Figure 6:
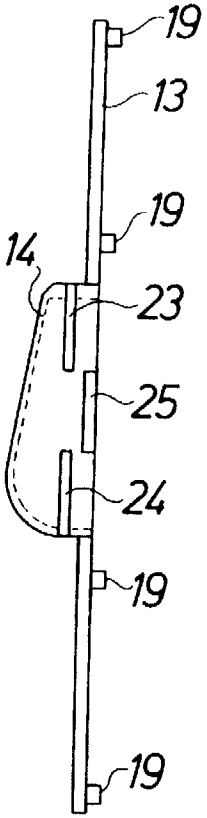
Figure 5:
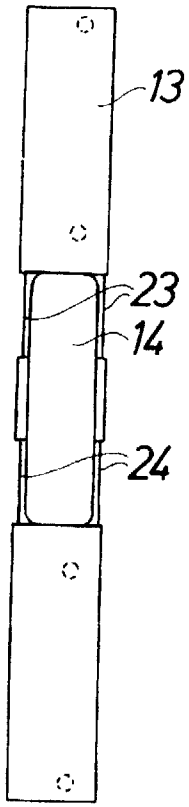
Figure 4:
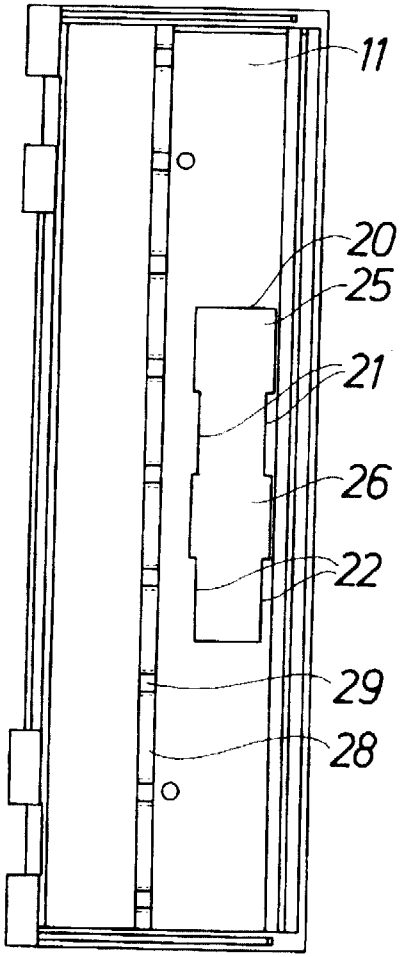
Figure 2:
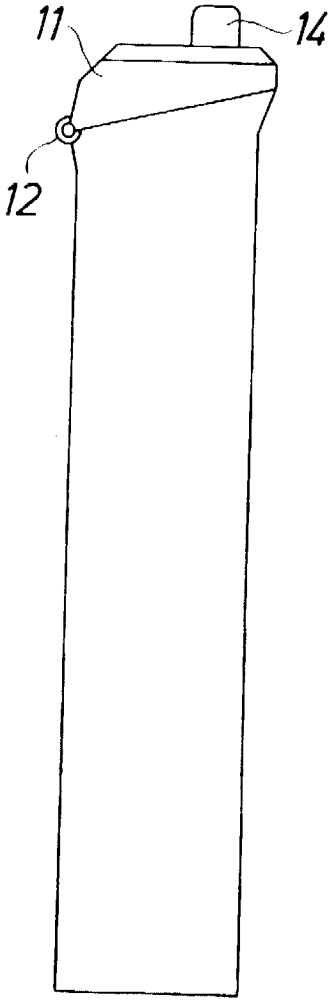
Figure 8:
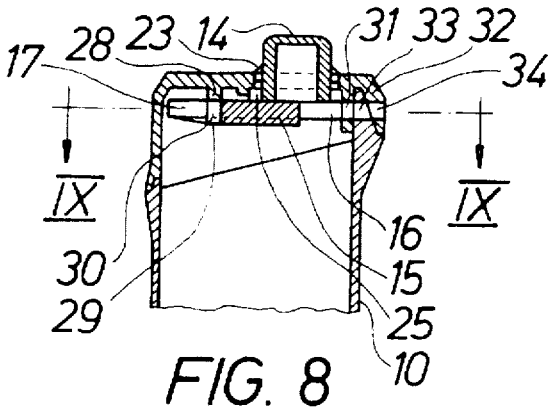
Figure 9:
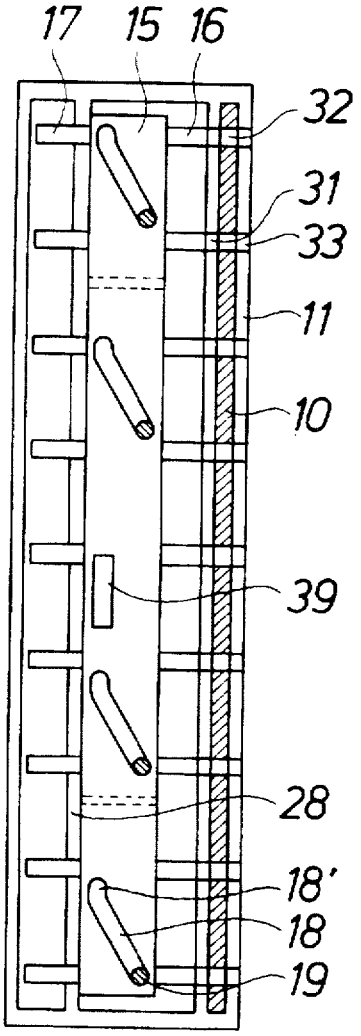
Figure 10:
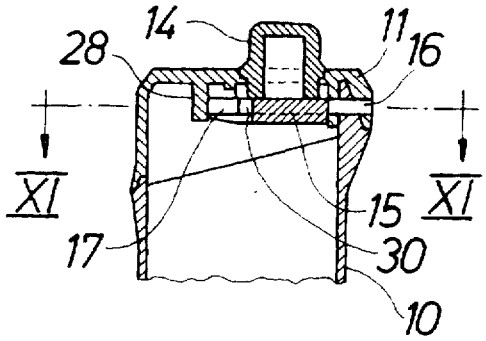
Figure 11:
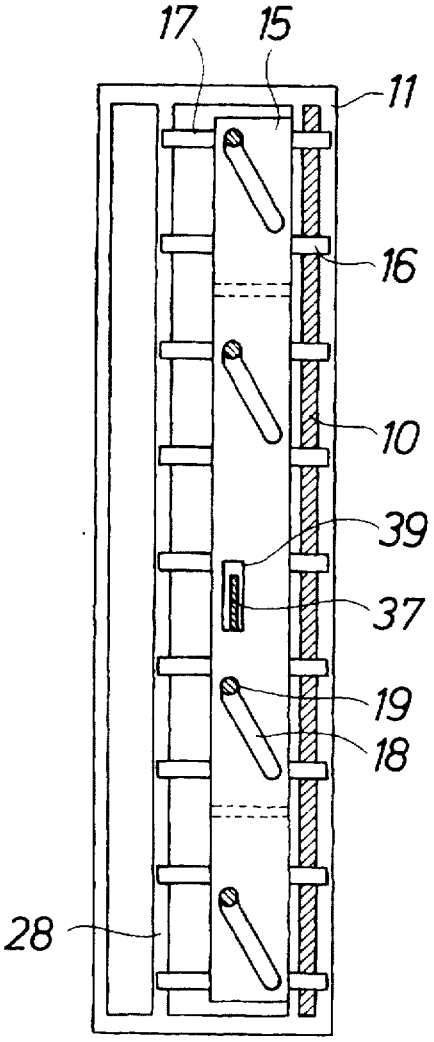
Figure 15:
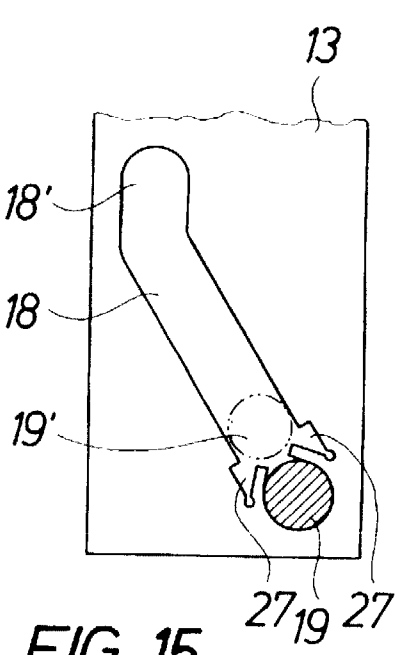
Figure 14:
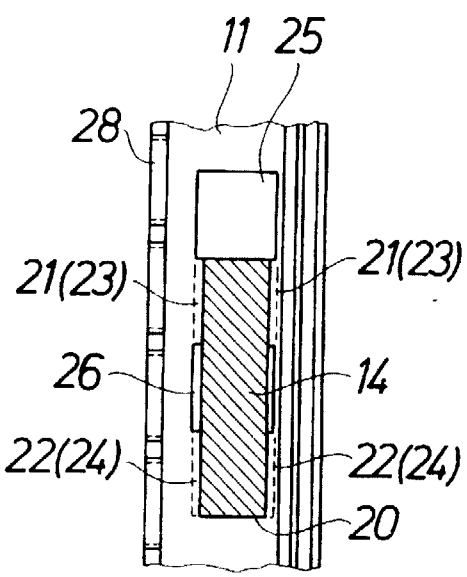
Figure 13:
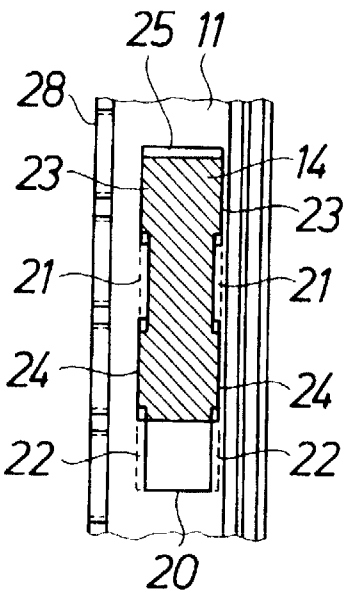
Figure 12:
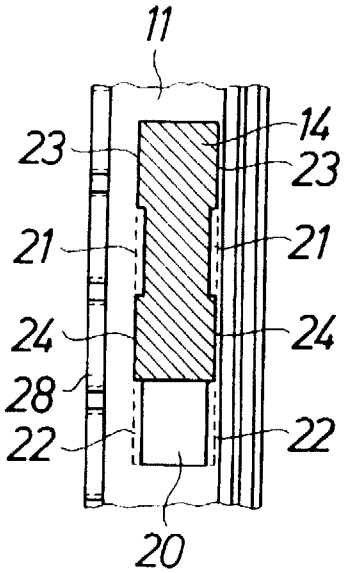
Figure 16:
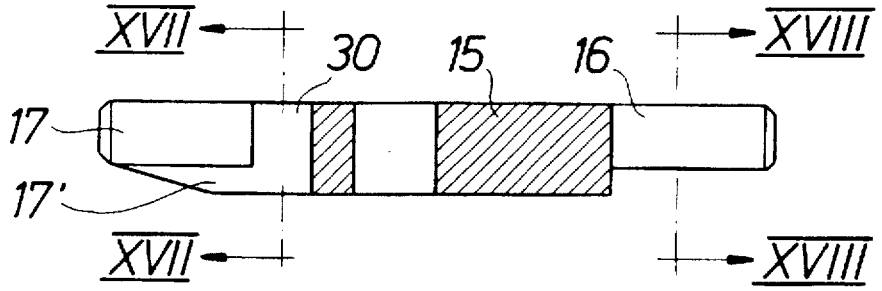
Figure 17:
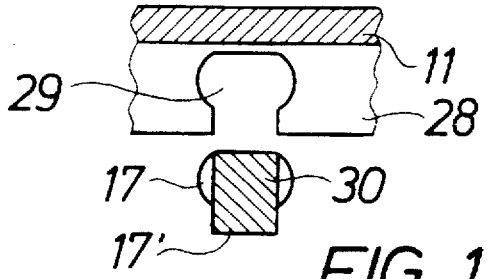
Figure 18:
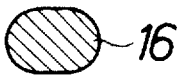
Figure 19:
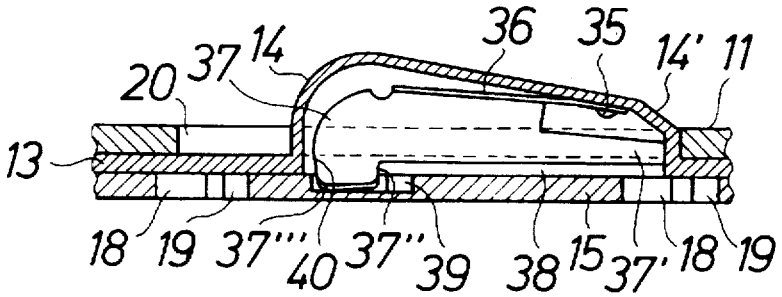
Figure 20:
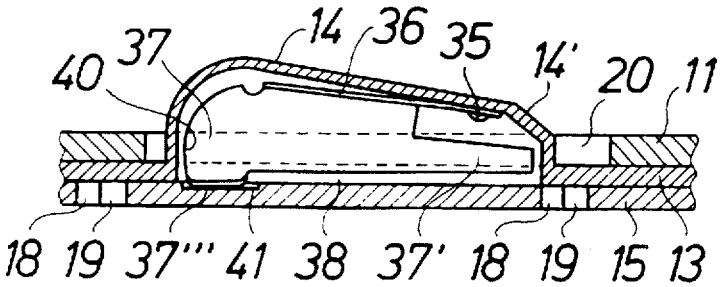
Figure 21:
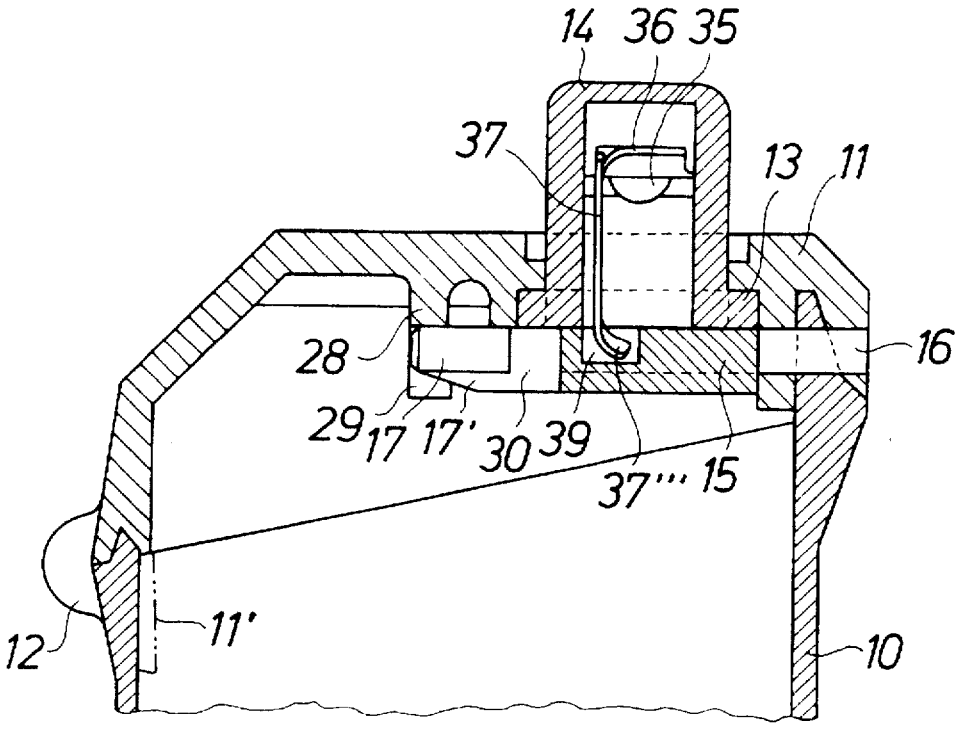
Figure 22:
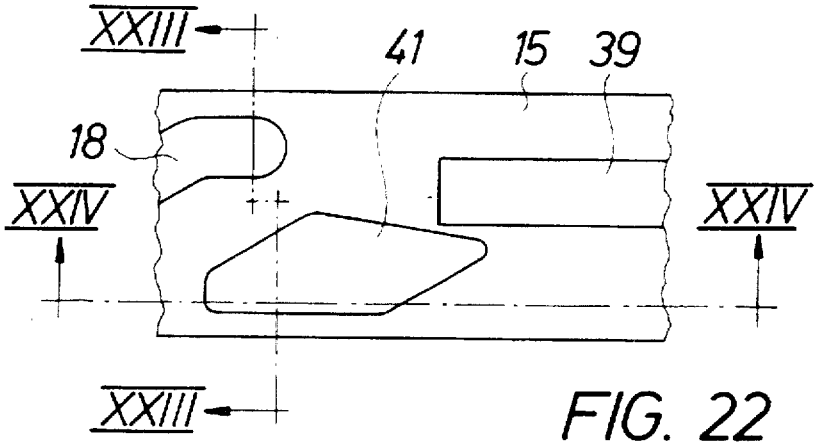
Figure 23:
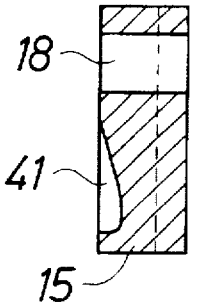
Figure 24:
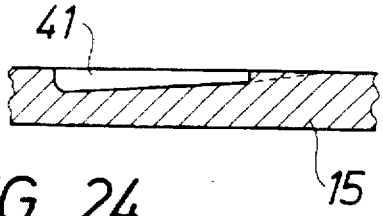
Figure 25:
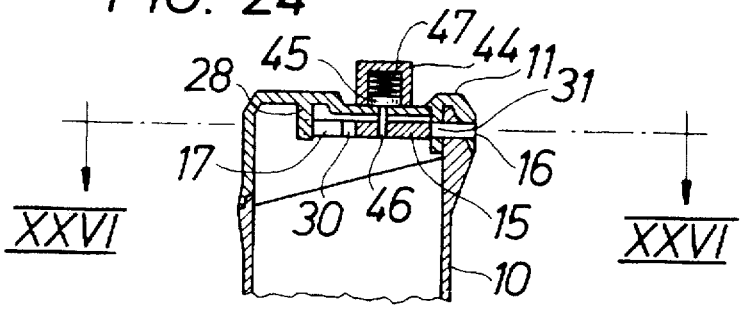
Figure 26:
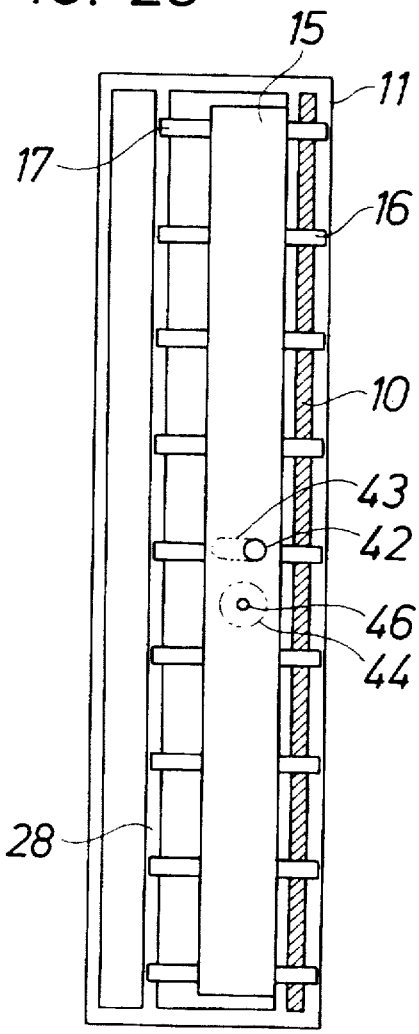
Figure 27:
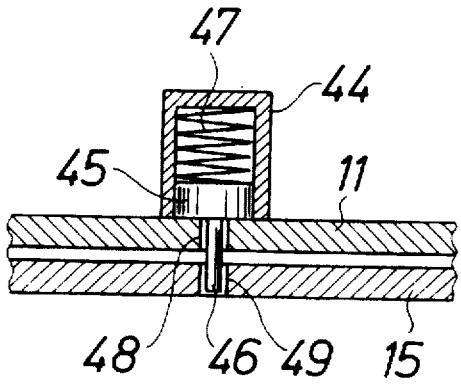

The invention will be described in more detail with reference to the accompanying drawings which disclose an illustrative embodiment and wherein FIG. 1 is a side view of an anti-theft box with lock mechanism according to the invention, FIG. 2 is an end view of the box in FIG. 1, FIG. 3 is a plan view of the box in FIG. 1, FIG. 4 is an enlarged plan view of the lid of the box as seen from below, FIG. 5 is a plan view of an operating slide, FIG. 6 is a side view of the operating slide, FIG. 7 is a plan view of a lock slide, FIG. 8 is a fragmentary vertical cross sectional view of the upper portion of the box with the lid provided with operating slide and lock slide in a mounting position, FIG. 9 is an horizontal cross-sectional view along line IX—IX in FIG. 8, FIG. 10 is a view corresponding to FIG. 8 with the lock slide in locking position, FIG. 11 is a horizontal cross-sectional view along line XI—XI in FIG. 10, FIG. 12 is a fragmentary view of the lid as seen from below with the lock slide indicated in mounting position, FIG. 13 is a view corresponding to FIG. 12 with the operating slide indicated in open position, FIG. 14 is a view corresponding to FIG. 12 with the operating slide indicated in closed position, FIG. 15 is an enlarged fragmentary plan view of the lock slide, FIG. 16 is an enlarged-cross-sectional view of the lock slide, FIG. 17 is an enlarged cross-sectional view along line XVII—XVII of a guide pin on the lock slide with a portion of the lid provided for co-operation with said pin shown in side view, FIG. 18 is a cross-sectional view along line XVIII—XVIII of a lock pin on the lock slide, FIG. 19 is a vertical cross-sectional view partly a side view of a latch mechanism forming part of the lock, in engaged position, FIG. 20 is a view corresponding to FIG. 19 but with the latch mechanism in disengaged position, FIG. 21 is an enlarged view similar to FIG. 10 and discloses the latch mechanism in engaged position, FIG. 22 is a fragmentary plan view of the operating slide and discloses the arrangement of the slide for co-operation with the latch mechanism, FIG. 23 is a cross-sectional view along line XXIII—XXIII in FIG. 22, FIG. 24 is a cross-sectional view along line XXIV—XXIV in FIG. 23, FIG. 25 is a fragmentary vertical cross-sectional view similar to FIG. 10 of the upper portion of the box in a modified embodiment having a lock slide only which is shown in engaged position, FIG. 26 is a horizontal cross-sectional view along line XXVI—XXVI in FIG. 25, FIG. 27 is a fragmentary vertical cross-sectional view, partly a side view, of a latch mechanism forming part of the lock according to FIGS. 25 and 26, in engaged position, and FIG. 29 is a view corresponding to FIG. 27 but with the latch mechanism in disengaged position.

In FIGS. 1 to 3 there is disclosed an anti-theft box according to the invention which is preferably transparent and is made of rigid plastics. The box includes a cassette 10 for receiving the object or objects to be protected against theft and has a lid 11 which is pivotally mounted to the cassette by means of hinges 12. The interface between lid and cassette is inclined in order to reduce the build-up depth at stacking. The lid can be locked in closed position by means of a lock mechanism which is operated by displacing a lock slide 13 at a housing 14 provided on the lock slide, which is available exteriorly of the lid and encloses a lock or latch mechanism of the type described in WO 92/18734 and can be operated by means of a magnet. An element forming a dipole or a magnetic tape for wireless actuation of an electronic alarm system is provided on or in the anti-theft box in a manner known per se but not shown in detail herein. Elements of different types are known per se, and the object thereof is to disturb an electrostatic or electromagnetic field between two bows defining a passage in an exit of a shop or department store, when carried through said field, an alarm device as a consequence thereof being activated via electronic circuits. This is an anti-theft technique known per se. The lock mechanism is mounted in the lid 11 and will be described in more detail with reference to FIGS. 4 to 18.

The operating slide 13 shown in FIGS. 5 and 6 comprises an elongated flat slide to which the housing for the latch mechanism is attached; said housing can also be integral with the operating slide. The operating slide is constructed for co-operation with a lock slide, FIG. 7, which also comprises an elongated flat slide having a number of lock bolts 16 with round cross section and projecting from one longitudinal edge, and an equal number of guide bolts 17 with round cross section and projecting from the other longitudinal edge said lock and guide bolts being co-axial with each other. It is not necessary that the number of guide bolts is the same as the number of lock bolts or that the bolts are coaxial though this is the case in the embodiment described. Four oblique guide slots 18 are provided in the lock slide, and the operating slide 13 which shall lay on top of the lock slide 15 when the slides are mounted in the lid 11, has on the lower side thereof four from said side perpendiculary projecting coupling pins 19 for engagement with the guide slots 18.

Mounting of the slides with the operating slide 13 laying flat on top of the lock slide 15 in a predetermined displaced position which will be termed mounting position takes place from the lower side of the lid the housing 14 being passed upwards through a rectangular opening 20, FIGS. 3 and 4, in the lid 11. At the opposite longitudinal edges of this opening here are two shoulders 21 and 22 mutually spaced in the longitudinal direction of the opening, and on the outside of the housing 14 two pairs of ribs 23 and 24 are provided extending in the longitudinal direction of the operating slide and having the same length as the shoulders 21 and 22. Between the ribs 23 and 24 there is provided at each side of the housing 14 a projecting rib 25 which also extends in the longitudinal direction of the operating slide 13 in the same plane as the operating slide and has the same thickness as said slide and in fact is formed by a portion of the operating slide. The ribs 23 and 24 are displaced in the transverse direction of the slide in relation to the ribs 25 as can be clearly seen from FIG. 6. Between the shoulders 21 and the shoulders 22, respectively, the opening 20 has a width which corresponds to the width of the housing 14, while the slot between the shoulders 21 and one end edge of the slot has a portion 25 the width of which corresponds to the spacing between the free edges of the ribs 23 and the length of which corresponds to the length of the ribs 23. Between the shoulders 21 and 22 the opening 20 has a portion 26 which is as large as the portion 25 and the width of which corresponds to the spacing between the free edges of the ribs 24 and the length of which corresponds to the length of the ribs 24. Thus, the housing can be passed from below through the opening 20 in the lid by passing the ribs 23 through the opening portion 25 and the ribs 24 through the opening portion 26, which is illustrated in FIG. 12 where the housing is indicated as an hatched area. The housing 14 should be passed through the opening 20 with pins 19 located in one end of the slots 18 as shown in FIG. 9, and the pins are kept in this position in the slots by resilient tongues 27 which are provided in at least one slot 18, in the embodiment shown in two slots, FIG. 15, so that the pins are arrested at one end of the slots 18.

On the lower side of the lid 11 there is provided a web 28 with apertures 29 the number and pitch of which correspond to the number and pitch of the bolts 16 and 17. In FIG. 17 one of the apertures 29 in the web 28 is shown, and as will be seen said apertures have substantially the shape of a key hole. Each guide bolt 17 has a portion 30 which is flat at opposite sides of the bolt and thus is narrower than the bolt, and this portion is not wider than it can pass through the narrow portion of the apertures 29 when the housing 14 in said mounting position is passed through the opening 20 from the lower side of the lid in order that the guide bolts 17 then will be received in the wider portion of the apertures 29.

The bolts are also reinforced by means of a flange 17' on the lower side thereof having the same width as the portion 30 so that it can be received in the narrow portion of the aperture 29. Also the lock slide 15 is reinforced by the central portion thereof (substantially over the five central lock bolts) has greater thickness than the rest of the slide. The bolts 16 and 17 as shown in FIGS. 17 and 18 have substantially oval cross-sectional shape but they can have another cross-sectional shape e.g. circular or square. As will be seen from FIG. 8 the lock slide is in such displaced position in the transverse direction of the slides when the operating slide is in the mounting position, that the lock bolts 16 are completely withdrawn into the slide with the ends thereof in register with an aperture 31 in the lid. The lid has a V-shaped edge portion 32 to receive therein in the closed position of the lid the tapering edge portion of the cassette, as shown in FIG. 8. Then, the aperture 31 is in register with the corresponding aperture 33 in the edge portion of the cassette. The V-shaped edge portion 32 has a co-axial continuation of the aperture 31, indicated at 34, and as will be seen from FIG. 8 apertures 31, 33 and 34 are co-axial in the closed position of the lid.

It is accordingly possible in the mounting position of the slides according to FIGS. 8 and 9 to pass the housing 14 through the opening 20 the flat portions 30 of the guide bolts 17 being received by the apertures 29 in the web 28 on the lower side of the lid and the lock bolts 16 being located inwardly of the edge portion 32 of the lid, which means that these bolts do not extend into the apertures 31.

The next step in the mounting of the operating and lock slides 13 and 15, respectively, is that the housing 14 is displaced so much in the opening 20 by displacing the operating slide 13 in plane parallel fashion in the longitudinal direction of said slide that the pins pass by the tongues 27 which are pressed aside elastically by the pins and spring back behind said pins when they have reached the position 19' in FIG. 15. The pins 19 then cannot again be returned to the position at the end of the slots 18 according to FIG. 15. By this displacement of the operating slide 13 and the pins 19, the lock slide 15 is displaced slightly to the right as seen in FIGS. 8 and 9 so that the lock bolts 16 will penetrate into the apertures 31 but not into the apertures 33. There is thus effected a plane parallel displacement of the slides engaging each other in mutual perpendicular directions. The housing 14 is now in the position indicated in FIG. 13 the operating slide 13 being displaceably retained in the lid 11 by the shoulders 21 and 22 being partly received between the ribs 23 and 24, respectively, and the ribs 25. The lock bolts 16 and the guide bolts 17 are displaceably received in the apertures 31 and the apertures 29, respectively, the plane portion 30 being displaced laterally in relation to the web 28 so that the guide bolts 17 cannot again pass through the narrow portion of the apertures 29. The slides are now in a position which may be termed the open position because the lock bolts 16 do not prevent the lid 11 from being swung upwards.

In order to lock the lid 11 in the closed position the operating slide 13 is displaced to the position according to FIG. 14 the pins 19 as a consequence thereof being displaced in the slots 18 to the position shown in FIG. 11 and the lock slide 15 being displaced to the right as seen in FIG. 9 so that the lock bolts 16 are passed through the aperture 33 in the upper edge of the cassette 10 and into the aperture 34 in the lid 11. The locked position is shown in FIGS. 10 and 11. In this position the pins 19 are received in a portion 18' of the slots 18, which extends in the longitudinal direction of the lock slide 15. This makes it difficult to press the lock bolts 16 back if one tries to open the anti-theft box in this manner.

It is of course necessary to latch the lock slide 15 in the locking position, and for this purpose there is in the housing 14 a lock or latch mechanism which principally is of the embodiment described in WO 92/18734 and will be described with reference to FIGS. 19 to 24. The latch mechanism comprises a spring blade 36 of a material which can be attracted magnetically, said spring blade being fixed in the housing 14 at one end thereof at 35. The spring blade forms an angled flap 37. The rear portion 37' of the flap projects freely by being separated from the spring blade. The flap forms a shoulder 37" and forms an edge portion 37'" angled laterally as will be best seen from FIG. 21. The spring blade is normally in the position according to FIGS. 19 and 21, and then the portion 37' has the free end thereof in engagement with the housing 14 (FIG. 19). The spring blade extends through an opening 38 defined by the housing in the operating slide 13 (FIGS. 19 and 20) and engages into a rectangular hole 39 in the lock slide 15 which can be a bottom hole as shown or a through hole. In this position which is the latching position of the latch mechanism the flap 37 prevents displacement of the operating slide 13 in order to open the lock. The flap has a straight edge 40 which in the latching position of the spring blade extends downwards and backwards, said edge engaging the edge of the hole 39 if one tries to move the operating slide 13 in the opening direction the portion 37' at the free end thereof abutting the housing 14. By the housing 14 forming a chamfered surface 14' attempts of unauthorized displacement of the lock slide to the open position by smashing the lock housing against the edge of a table or the like is prevented.

In order that the lock can be opened the spring blade 36 must be brought to the disengaged position shown in FIG. 20 wherein the flap 37 is withdrawn from the bottom hole 39 in the lock slide 15. The spring blade is brought to this position by means of a special tool provided as an external magnet which is moved towards the housing 14 from the outside thereof as described in WO 92/18734. When the flap 37 has been withdrawn from the hole 39 the operating slide can be displaced to the open position with the flap sliding at the end edge thereof on top of the lock slide which is displaced in the transverse direction thereof to the left as seen in FIG. 11 for withdrawal of the lock bolts 16 from the apertures 34 and 33 but not from the aperture 31. For this to happen continued displacement of the operating slide 13 and the lock slide 15 is required which is prevented by the tongues 27, FIG. 15.

When the flap 37 after having been raised from the hole 39 by means of the magnet slides on the lock slide 15 it will be received by a depression 41 having a bottom sloping in the transverse direction as well as the longitudinal direction of the operating slide as seen in FIGS. 22–24. Since the spring blade 36 moves together with the operating slide 13 when this is displaced in the longitudinal direction thereof, and the lock slide 15 moves in relation to the spring blade 35 in the transverse direction thereof the depression 41 can have irregular shape as shown in FIGS. 22 but it can also be rectangular. Sliding of the spring blade against the lock slide 15 is facilitated by the edge portion 37' angled laterally, which engages the lock slide. By the flap 37 engaging the depression 41 the lock slide will be maintained in the open position but can easily be brought to the locking position when locking shall take place again, the operating slide 13 being displaced to the position in FIG. 11 with the spring blade sliding on top of the lock slide 15 in the depression 41 and being successively raised from said depression by the sloping bottom in order to finally snap into the hole 39 under its own spring bias.

Another latch mechanism than that shown herein can be provided, and it is also conceivable to arrange the latch mechanism on the lid 11 for engagement with the operating slide and/or the lock slide and thus prevent displacement of the lock slide.

FIGS. 24 to 27 show an embodiment thus modified wherein there is no operating slide, only the lock slide 15 being provided. It is mounted in the same manner as in the embodiment earlier described, and as in the embodiment earlier described the lock slide can be displaced in the transverse direction thereof between an engaged position shown in FIG. 25 and a disengaged position wherein the lock bolts 16 engage in the aperture 31 only. When the lock slide is being mounted it is inserted at the narrow portion 30 thereof into the apertures 28 and is then displaced to the right in order that the lock bolts 16 shall pass into the apertures 31 but no longer. Then an operating pin 42 is passed from the lower side of the slide through a transverse slot 43 in the slide and is attached to the lock slide 15; it can be screwed, welded or snapped to the lock slide. The slot 43 has such length that displacement of the lock slide 15 in the transverse direction thereof is allowed only between the disengaged position of the lock bolts 16, the lock bolts being received in the apertures 31, and the locking position of the lock bolts the lock bolts extending further through the apertures 33 and 34 as described above.

Figure 28:
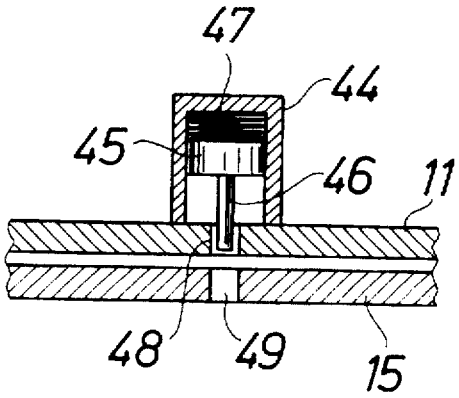

A latch mechanism is provided for latching the lock slide in the engaged position said latch mechanism being enclosed in a cylindrical housing 44 mounted to or integrated with the housing 14. A piston 45 is displaceably mounted in the housing 44 and has a pin 46 attached to the piston, and is biassed by means of a compression spring 47 in the housing to the position shown in FIGS. 25 and 27 wherein the pin 46 extends through an aperture 48 in the lid 11 and into an aperture 49 coaxial with the aperture 40 in the lock slide 15. The latch mechanism is brought to the disengaged position according to FIG. 28 wherein the pin 46 is withdrawn from the aperture 49 and is located solely in the aperture 48, against the bias of the spring 47 by means of an external magnet which is moved towards the housing 44 in order to attract the piston 45 which implies, of course, that the piston is made of a metal which can be attracted magnetically. The latch mechanism as such is of a kind known per se. When the latch mechanism is in the disengaged position the slide can be displaced to the left at the pin 42 as seen in FIG. 25 in order to disengage the lock bolts from the cassette 10. The magnet can be built into the bottom of a circular depression in an opening tool the housing 44 being inserted into said depression in order to actuate the piston magnetically, and a carrier in the tool can displace the pin 42 when the box is rotated with the housing 44 as a pivot. Actuation of the latch mechanism to the disengaged position and unlocking of the box thus can take place by a simple manipulation.

In the embodiment shown the lid is pivotally mounted but it is also conceivable to provide a displaceable lid which is locked in the closed position thereof by means of the lock mechanism constructed as described herein. As indicated by dot and dash lines 11' in FIG. 21 the lid when pivotally mounted can have an inside flange which extends over the interface between the lid and the cassette and preferably extends over that part of the lid which extends between the hinges 12. Such a flange makes it difficult to break the lid by introducing a tool in the interface.

It is not necessary that the anti-theft box has parallelepipedic shape as shown herein. It can be of another shape for example cylindrical, oval or polygonal.

It is preferred to effect mounting of the lock mechanism in the manner described herein because mounting then can be effected without the use of tools but other methods for displaceably mounting the operating and lock slides are of course conceivable. However, the mounting then may be more complicated because welding or screwing must take place.

I claim:

1. Anti-theft box for displaying goods that are attractive by theft in shops and department stores, comprising:

a cassette;

a lid on the cassette;

an element for wireless activation of an alarm device if the anti-theft box is carried through an exit of a shop or a department store;

a lock slide on the inside of the lid;

lock bolts on the lock slide which is displaceable back and forth in plane parallel fashion in order to bring the lock bolts into and out of locking engagement with the cassette;

a latch mechanism for the lid having a latching position in which the lock slide is latched with the lock bolts in engaged position, and an unlatching position allowing displacement of the slide to bring the lock bolts out of locking engagement, said latch mechanism being switched to the unlatching position by means of a special tool;

an operating slide which is plane parallel with the lock slide and is operatively connected therewith to effect displacement thereof and which can be actuated manually and be displaced back and forth in plane parallel fashion transversely of a moving direction of the lock slide, said latch mechanism being provided on and is displaceable together with the operating slide to engage with the lock slide in the latching position thereof.

2. Anti-theft box according to claim 1, wherein the latch mechanism comprises a spring blade which is biased by spring action to engaged position but which can be actuated to disengaged position by attraction to a magnet functioning as the special tool.

3. Anti-theft box according to claim 1, further comprising a housing enclosing the latch mechanism, said housing being provided on the operating slide and forming an operating member for the operating slide, which can be actuated manually.

4. Anti-theft box according to claim 3, wherein the housing can be passed into an opening in the lid from the lower side thereof, the operating slide being applied against said lower side, the lock slide engaging the lower side of the operating slide.

5. Anti-theft box according to claim 4, further comprising guide bolts projecting perpendicularly from one longitudinal edge of the lock slide and forming an axial portion with reduced width, which can be inserted at a lower side of the operating slide into apertures for the guide bolts through guide slots which connect to said apertures, and wherein said portions by initial displacement of the operating slide towards the engaged position of the lock bolts can be displaced axially from the position in said apertures for the guide bolts, the guide bolts at a portion which is wider than the slots, being inserted into the apertures.

6. Anti-theft box according to claim 5, wherein the guide slots in the operating slide have an end portion for receiving the coupling pins on the operating slide with the guide bolts on the lock slide in position for insertion into the apertures on the lower side of the lid, and said portion is defined by means of resilient tongues which by resilient yielding allow displacement of the coupling pins to rest of the slot but prevent insertion of the coupling pins again into said portion.

7. Anti-theft box according to claim 6, further comprising guides are provided on the operating slide and the lid, respectively, to prevent withdrawal of the housing from the opening in the lid after said initial displacement of the operating slid.

8. Anti-theft box for displaying goods that are attractive by theft in shops and department stores, comprising:

a cassette;

a lid on the cassette;

an element for wireless activation of an alarm device if the anti-theft box is carried through an exit of a shop or a department store;

a lock slide on an inside of the lid;

lock bolts on the lock slide which is displaceable back and forth in plane parallel fashion in order to bring the lock bolts into and out of locking engagement with the cassette;

a latch mechanism for the lid having a latching position in which the lock slide is latched with the lock bolts in engaged position, and an unlatching position allowing displacement of the lock slide to bring the lock bolts out of locking engagement, said latch mechanism being switched to the unlatching position by means of a special tool;

an operating slide which is plane parallel with the lock slide and is operatively connected therewith to effect displacement thereof and which can be actuated manually and be displaced back and forth in plane parallel fashion transversely of a moving direction of the lock slide; and coupling pins on the operating slide operatively connecting the operating slide with the lock slide by engaging into slots in the lock slide said slots being angled to transform movement of the operating slide in a longitudinal direction of the slides to movement of the lock slide in the transverse direction of the slides.

* * * * *